US006283183B1

(12) United States Patent
Cooper

(10) Patent No.: US 6,283,183 B1
(45) Date of Patent: Sep. 4, 2001

(54) ULTIMATE ORGANIZER HANDBAG

(76) Inventor: Arline Cooper, 1824 13th St. NW., Washington, DC (US) 20009

( * ) Notice: Subject to any disclaimer, the term of this patent is extended or adjusted under 35 U.S.C. 154(b) by 0 days.

(21) Appl. No.: 09/504,110

(22) Filed: Feb. 15, 2000

(51) Int. Cl.[7] ..... A45C 2/00; A45C 13/10

(52) U.S. Cl. ..... 150/112; 150/118; 190/103; 190/110; 190/903

(58) Field of Search ..... 150/112, 118; 190/110, 901, 903, 103

(56) References Cited

U.S. PATENT DOCUMENTS 2,631,632 * 3/1953 Leachman ..... 190/901 X
5,829,502 * 11/1998 Distefano et al. ..... 190/110 X

* cited by examiner

*Primary Examiner*—Sue A. Weaver

(74) *Attorney, Agent, or Firm*—Steven Kreiss

(57) ABSTRACT

The present invention provides a handbag equipped with a zipper for opening a section of the bag located between the front and interior walls thereof. When this section of the bag is unzipped, the faces of said front and interior walls are exposed and permit a user to obtain various handbag items from pockets attached to said faces. The bag may be carried in the hand or over the shoulder as a result of a loop and ring arrangement which are connected by an adjustable strap and buckle arrangement. Other sections of the bag contain loop and ring arrangements for rapidly obtaining keys, a pager, a cosmetic pouch or the like. By virtue of the present invention, all contents of the inventive bag can be easily and quickly accessed by a user with one easy motion, while the bag is on or off his shoulder, without placing the bag on a flat surface.

8 Claims, 9 Drawing Sheets

ULTIMATE ORGANIZER HANDBAG

BACKGROUND OF THE INVENTION

The Ultimate Organizer invention relates to "handbags," "shoulder bags" or "bags" for carrying a multitude of personal or other items. Handbags and their use have been well known in the prior art. Handbags have had hand straps, shoulder straps and/or back straps. They have generally been large enclosures, sometimes with separated spaces, sometimes not, sometimes with defined compartments, oftentimes not.

The following described bags are exemplary of the prior art, but are distinguishable from the invention disclosed herein as noted in the description below. U.S. Pat. No. 5,829,502: This '502 handbag comes closest in concept to the inventive Ultimate Organizer, but does not begin to provide its functions. First, the contents of this prior art '502 handbag cannot be accessed while the bag is being worn by a user. Because it opens in half, it must be placed on a surface and laid flat to provide content access. While the user is wearing the herein described invention, the Ultimate Organizer, in a vertical position, all contents of the bag can be accessed without placing the bag on a flat surface. In addition, the Ultimate Organizer has compartments which can accommodate a pad, pen, credit cards, cell phone, pager, cosmetics and/or other items. The prior art '502 handbag does not have such compartments. Further, the '502 bag's change purse can only be accessed after the bag is placed on a flat surface, the bag is almost fully unzipped, the inner purse is further unzipped or the compartment is opened, and the user gropes for change inside either the zippered purse or the compartments located on the inner walls. The same holds true for locating a key or keys. The Ultimate Organizer, however, allows the user with one motion to easily and quickly access change without unzipping the bag or its compartments or lying the bag flat. The change can be accessed while the bag is worn in a vertical position (therefore requiring no surface to lay the bag on), and the same ease of access is true for locating keys.

U.S. Pat. No. 2,466,208: This prior art describes an apron bag. First, the '208 apron bag must be worn around the waist. Unlike the Ultimate Organizer, it cannot be used on the back of a user, moved under either arm of a user or be worn over or across the shoulder. The '208 apron bag only has two outside panels with no additional depth of pouches, unlike the Ultimate Organizer. The '208 apron bag opens in a 180-degree arc. In order to keep the bag from flopping closed while the user is walking, the '208 patent recommends "strapping it to the user's leg!" This is impractical. On the other hand, the Ultimate Organizer has an interior flap which automatically flips up or down to accommodate the zipping or unzipping of the outer walls and enables the user to wear the bag under or over the arm without having to "strap it" to a body part. The Ultimate Organizer can also remain in a vertical position and does not have to be laid flat to access the items stored in its compartments. The '208 apron bag has essentially two walls and no further interior compartments, while the Ultimate Organizer has two sections with further compartments which make accessibility easier while the user is sitting or standing.

U.S. Pat. No. 4,154,275: This prior art "handbag" is a top opening handbag with essentially one interior compartment and some exterior attachments, such as a watch and change purse. This '275 "handbag" cannot be worn on the back and cannot be swiveled under either arm. It requires a user to pull out the change purse, open the change purse, and then locate the change. The Ultimate Organizer, while it is worn under either the left or the right arm, enables the user to access change without pulling out a change purse from the bag and without taking the bag off the shoulder. The user simply reaches into the change pouch located near the top of the two interior walls where they meet with a non-zipped side wall and accesses the change with one motion. The same is true for the attached stretch key ring holder. Further, because the Ultimate Organizer has three interior chambers, only one of which is the zipped outer chamber with compartments, it will store more items which can be accessed readily from the top of or unzipped side of the bag as a result of such compartmentalization.

U.S. Pat. No. 2,631,632: The '632 prior art travel kit cannot be worn on the back and swiveled under the right or left arm or be worn across the shoulder. It must be laid on a surface to access the items in its compartments, unlike the Ultimate Organizer, which can be worn without interfering with the unzipping of the outer wall which contains personalized compartments. Further, the Ultimate Organizer has two chambers in addition to the zipped chamber containing the compartments and has a flap connecting the outer zipped wall to an interior wall so that compartmentalized items can be accessed from the top or side of the bag after the bag is unzipped.

U.S. Pat. No. 380,416: This reference features a handbag with a one-piece strap that requires the user to remove the bag and place it on a surface before the user can gain access to the items contained therein from the top of the bag. The '416 handbag cannot be worn on the back and swiveled under the left or right arm and worn while obtaining access to items inside the bag. Further, the '416 handbag has multiple openings accessed from the top, but does not have personalized compartments to keep needed items in place or accessed immediately through the unzipped side or top of the bag. It also does not have the sewn-in one motion accessible change purse or key chain.

U.S. Pat. No. 2,413,465: This prior art "Handbag" requires that the user remove his arm from under the bag and place it on a flat surface to access the items in the compartments. The Ultimate Organizer, however, can be worn on the back and swiveled under the left or right arm or slung over or across the shoulder. The Ultimate Organizer enables the user to wear the bag without interfering with the side unzipping of the bag which permits easy access to needed items in the personalized compartments.

SUMMARY OF THE INVENTION

This invention relates to a handbag/shoulderbag or the like wherein all its components are made of durable materials. The inventive handbag/shoulderbag or the like has an adjustable circular strap construction, which enables a user to wear it over the shoulder, under the arm, or on the back. With the touch of a finger, the bag moves from the back to under the right or left arm, depending on whether the user is right or left handed. With one motion, the bag moves into place for maximum accessibility (from the unzipped side or top of the bag) to the items contained in the individual compartments that are located inside the zipped walls which open approximately at a 45 or greater degree arc.

Once the bag is shifted under the arm of choice, which the user can do from either a standing or sitting position, the user, with one motion, can instantly access items due to the bag's side and bottom construction. The outside or front wall of the bag unzips at the point at which it engages a side wall. This opens the bag to a 45 degree or greater angle position. The front wall of the bag is connected to the bottom wall of the bag by a triangular flap that holds items inside the bag regardless of whether the bag is zipped or unzipped. Once the outside wall of the bag is unzipped or by reaching into the top of the bag, the user, with one motion, can access such things as a pad, pen, cosmetics, cell phone, credit cards, wallet, or other items, which are contained in individual compartments located inside or outside of the bag on the front or other walls and/or on the interior bag walls.

In addition to the outside zipped wall, the bag contains interior pockets (hereafter "the pockets") and storage areas. Therefore, when the user is wearing the bag either under the arm or over the shoulder, or across the shoulder, the user with one motion can reach, stretch and unlock any key hole using his key ring which is attached to a rubberized or elasticized key chain (or other coiled device) which is attached to a loop and ring arrangement on an inside wall of the bag. Thus, the user needs only to place his finger inside a pocket or storage area to instantly locate his key.

Furthermore, while the bag is under either arm or over the shoulder, the user in one motion, can quickly, easily and effortlessly access change with one or more fingers from a pouch sewn-in an uppermost corner of the bag between two interior walls without opening any closures. The pouch can be placed in any other strategic place in the bag for easy access.

No other bag prior to the inventive one described below contains all the features necessary for one motion accessibility to such items as a wallet, checks, pad, pens, coins, keys, credit cards, cosmetics, cell phone, pager, etc. In summary, the salient features of the Ultimate organizer bag are (a) an adjustable circular one piece strap that enables the user to carry the bag on his back and, with one touch, swivel the bag under either the left or right arm from a standing or sitting position to obtain access to the contents of the bag, (b) a zipped front, side and bottom wall which enables the user from the top side of the bag to access the contents of the bag from compartments while the bag is being worn by a user and (c) a magnetic or other closure which locks the zippered walls together and, when locked, permits a user to gain access to any compartmentalized items from the top or side of the bag with one easy motion.

This adjustable circular strap, which loops through rings mounted on top of the walls of the bag, in conjunction with the side and bottom unzipping of the bag and the magnetic or other wall closure, enables the user to immediately access important items stored in individual compartments such as change, keys, pager, pen and other items.

The strategic placement of the rings atop the bag walls enables an adjustable circular strap to easily loop through the rings, enables the bag to be unzipped at a 45 degree or greater angle on the side of the bag, and lets a user access from the top or side of the bag the contents of compartments located inside the zipped walls of the bag while the bag is being worn in a vertical position on the user or elsewhere. Also, because of the strategic placement of the rings atop the bag walls, a user can wear the bag on his back while his hands are free. Then, with one motion, the user can swivel the bag under the left or right arm. Finally, the elasticized pouch, key chain and transparent container permit immediate access to a comb, makeup coin change, keys and other items.

DESCRIPTION OF THE PREFERRED EMBODIMENT

Figure 1:
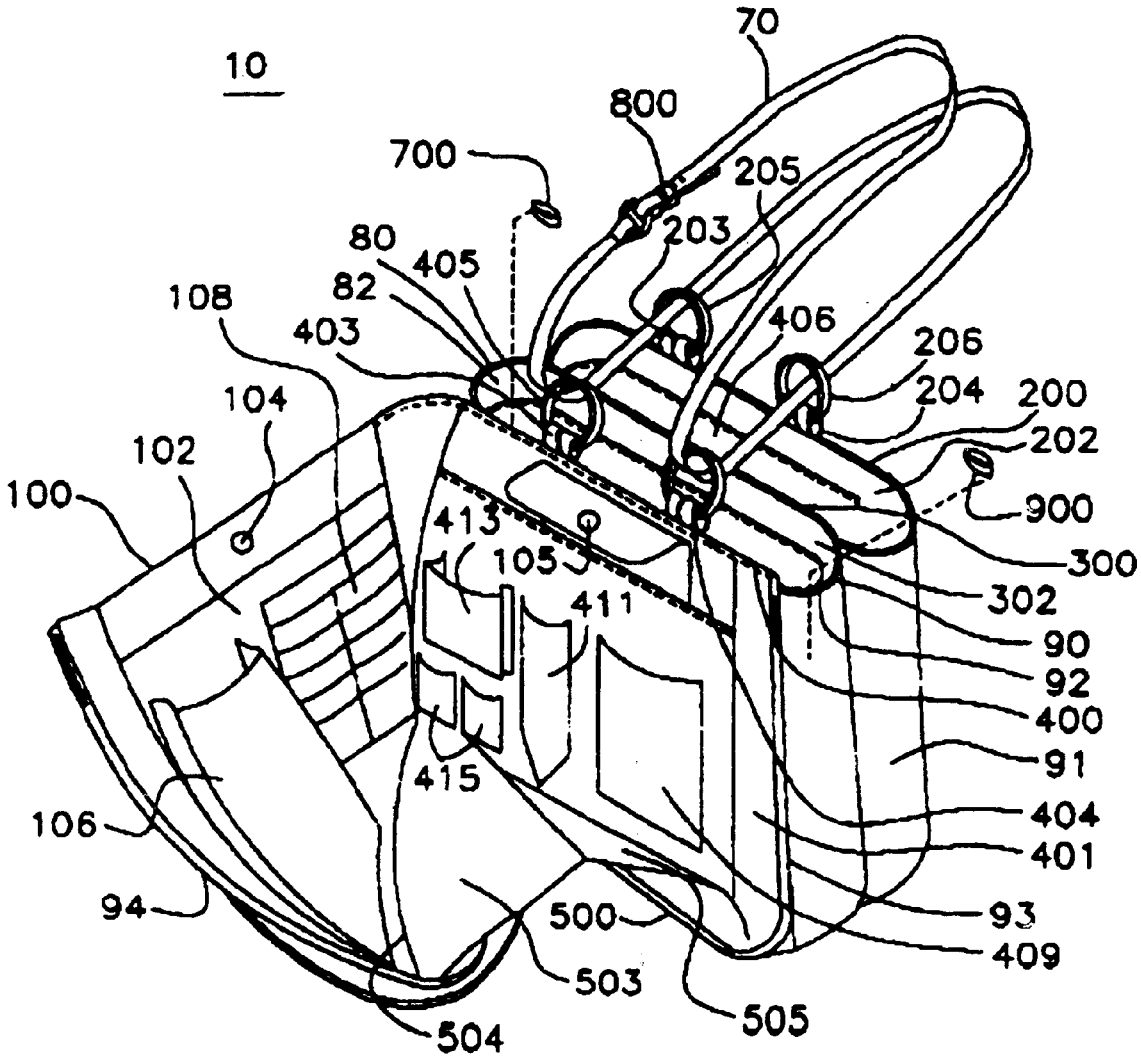
FIGS. 1–5 are front elevation views of the invention.

The Ultimate Organizer bag 10, shown in FIG. 1, contains seven walls: a front wall 100; a back wall 200; a first side wall 90; a second side wall 80; a bottom wall 500; a first interior wall 300; and a second interior wall 400. Each wall of bag 10 contains two faces: the front wall 100 is composed of a first face 101, shown in FIG. 4, facing the outside of the bag and a second face 102, shown in FIG. 1, facing the inside of the bag; the back wall 200 is composed of a third face 201, shown in FIG. 6, facing the outside of the bag and a fourth face 202, shown in FIG. 1, facing the inside of the bag; the first side wall 90 is composed of a fifth face 91, shown in FIG. 1, facing the outside of the bag and a sixth face 92, also shown in FIG. 1, facing the inside of the bag; the first interior wall 300 is located between the front and back walls 100 and 200 respectively and is composed of a seventh face 301, shown in FIG. 6, which faces the back wall 200, and an eighth face 302, shown in FIG. 1, which faces the front wall 100; the second side wall 80 is diametrically opposite first side wall 90 and is composed of a ninth face 81, shown in FIG. 6, facing the outside of the bag and a tenth face 82, shown in FIG. 1, facing the inside of the bag; the bottom wall 500 is composed of an eleventh face 501, shown in FIG. 7, facing the outside of the bag and a twelfth face 502, shown in FIG. 8, facing the inside of the bag; and the second interior wall 400 located between the front and first interior walls 100 and 300 respectively is composed of a thirteenth face 401, shown in FIG. 1, which faces the front wall 100, and a fourteenth face 402, shown in FIG. 6, which faces the eighth face 302 of the first interior wall 300.

As shown in FIG. 1, the first side wall 90 contains a male and female zipper attachment 93 and 94 respectively. This zipper attachment 93, 94 extends from the top of the first side wall 90 to and along the bottom wall 500 up to the second side wall 80, such that when the zipper is unzipped, the front wall 100 of the bag is in an open position with respect to the second interior wall 400 and forms approximately a 45 or greater degree angle with the second interior wall 400. When the zipper is unzipped, as shown in FIG. 1, a triangular flap 503, which is attached on one end 504 to the bottom wall 500 adjacent the bottom of front wall face 102 and on the other end 505 to the bottom wall 500 adjacent the bottom of second interior wall face 401, forms a portion of the bottom wall 500 of the bag 10 between the front and second interior walls 100, 400.

As shown in FIG. 1, attached to the top of back wall 200 of the bag is a first loop 203. This first loop 203 is positioned adjacent the second side wall 80 of the bag. Also attached to the top of the back wall 200 of the bag is a second loop 204. This second loop 204 is positioned adjacent the first side wall 90 of the bag. Each loop 203, 204 is made from a strong, flexible material. Attached to the top of the second interior wall 400 of the bag is a third loop 403. This third loop 403 is positioned adjacent the second side wall 80 of the bag. Also attached to the top of the second interior wall 400 of the bag is a fourth loop 404. This fourth loop 404 is positioned adjacent the first side wall 90 of the bag. Each loop 403, 404 is made from a strong, flexible material. The first and third loops 203, 403 are positioned on the bag so that they are approximately the same distance from the second side wall 80 of the bag. Likewise, the second and fourth loops 204, 404 are positioned on the bag so that they are approximately the same distance from the first side wall 90 of the bag. The first and third loops 203, 403, as well as the second and fourth loops 204, 404, are positioned such that they are in alignment with one another. Connected to the first loop 203 is a first ring 205 which may be made from a metal, plastic, fabric or the like. Similarly, second, third and fourth rings 206, 405, and 406 respectively are connected to second, third and fourth loops 204, 403, 404 respectively and may be made from the same type of material as first ring 205. An adjustable, circular strap 70, shown in FIG. 1, is fitted within each of the four rings 205, 206, 405 and 406. The circular strap 70 contains a buckle 800 so that the strap can be made adjustable, i.e. longer or shorter as the user desires.

Figures 2, 9:
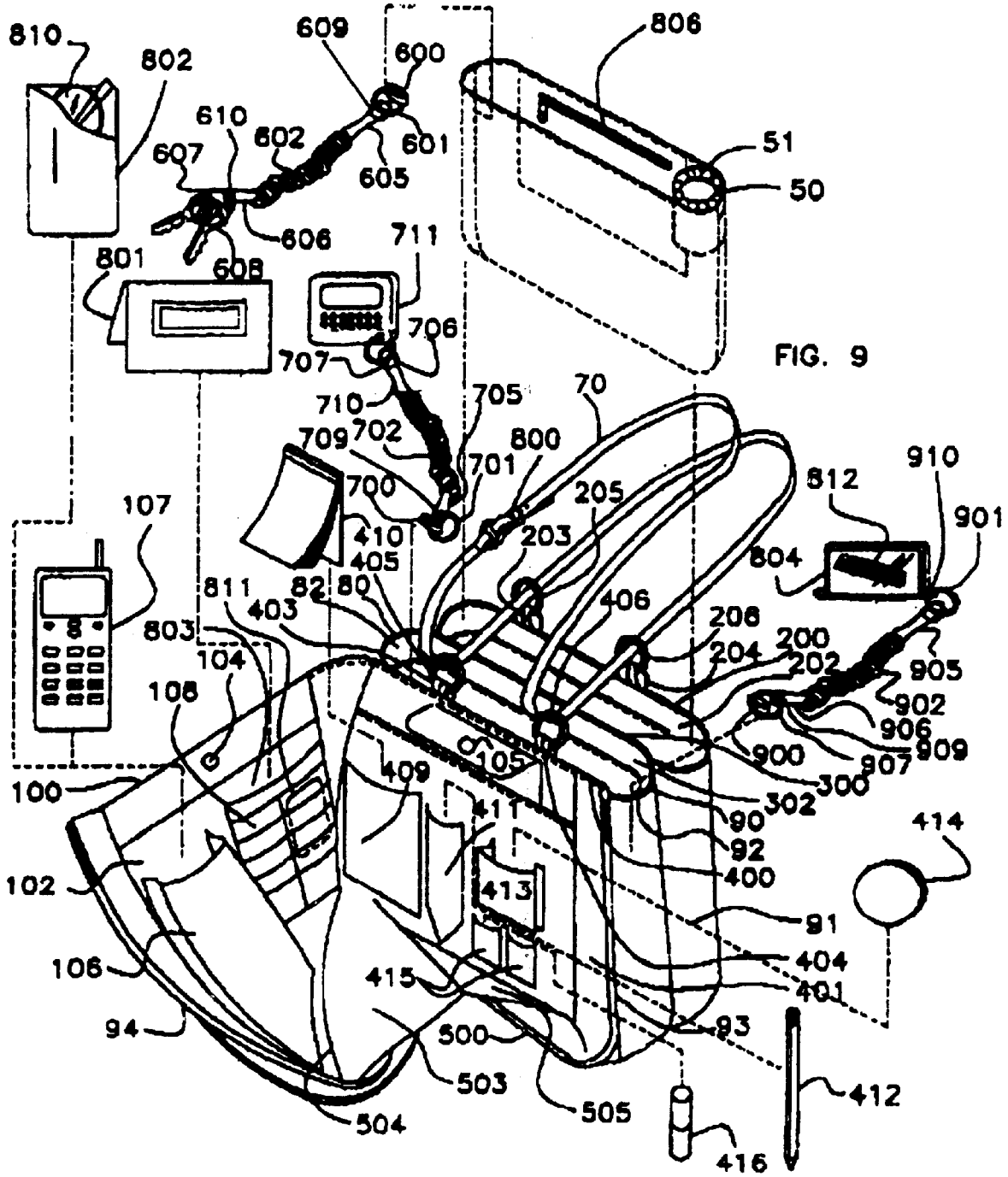
FIG. 9 is an inside in elevation view of the invention.

As shown in FIG. 9, a coin pouch 50 is sewn between the first interior and back walls 300, 200 respectively onto the top of the sixth face 92 of first side wall 90 of the bag. This pouch 50 may be made from any suitable material and is capable of containing coins. At the top of the pouch 50 facing the outside of the bag, is an elasticized section 51 which is normally in a closed position and prevents any coins therein from falling out of the pouch. When coins are placed into the pouch 50, they may be retrieved by a user placing his fingers into the elastic section 51 of the pouch 50 and pulling the coins out therefrom. Also shown in FIG. 9 is a zipped pocket 806 sewn onto fourth face 202 of back wall 200.

Figure 3:
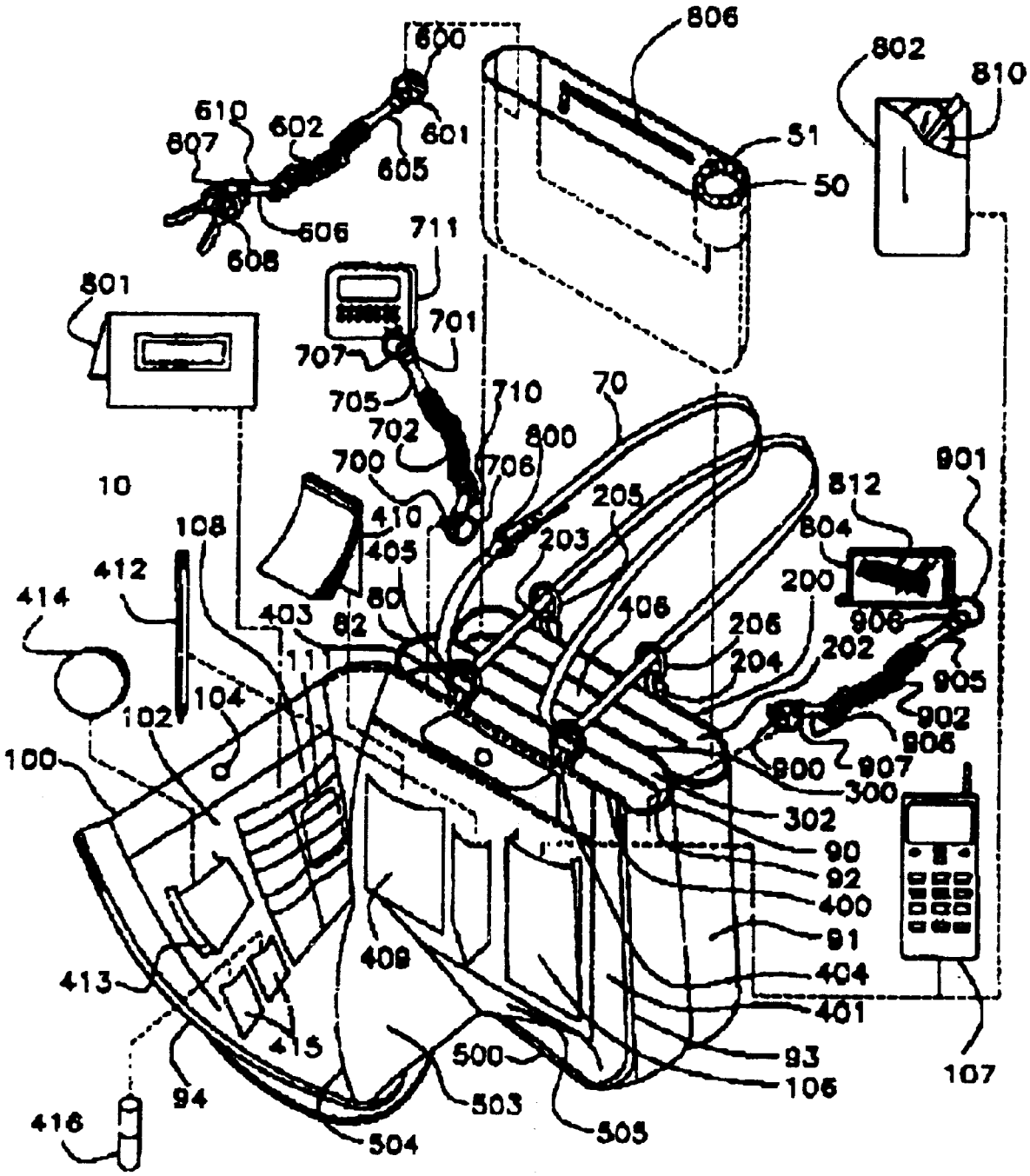

As shown in FIG. 9, attached to the tenth face 82 of the second side wall 80 between the first interior and back walls 300, 200 respectively is a fifth loop 600. As shown in FIG. 3, connected to fifth loop 600 is fifth ring 601. Connected to fifth ring 601 is a clip 605 which contains a hole 609 through which ring 601 fits through. Attached to clip 605 is an elasticized cord 602. Cord 602 may be made from a rubberized and/or other suitable material that compresses or lengthens as needed. Clip 605 is attached to cord 602 at one end and a corresponding clip 606 is attached to cord 602 on its other end. Clip 606 also contains a hole 610 through which a sixth ring 607 fits. Sixth ring 607 is a key ring and may contain any number of keys 608.

As shown in FIGS. 1 and 3, attached to tenth face 82 of the second side wall 80 between the first and second interior walls 300 and 400 respectively is a sixth loop 700. Connected to sixth loop 700 is seventh ring 701. Connected to seventh ring 701 is a clip 705 which contains a hole 709 through which ring 701 fits through. Attached to clip 705 is an elasticized cord 702. Cord 702 may be made from a rubberized and/or other suitable material that compresses or lengthens as needed. Clip 705 is attached to cord 702 at one end and a corresponding clip 706 is attached to cord 702 at its other end. Clip 706 also contains a hole 710 through which an eighth ring 707 fits. Eighth ring 707 is a pager ring and may be connected to a pager 711.

As shown in FIG. 2, attached to the sixth face 92 of first side wall 90 between the first and second interior walls 300, 400 respectively is a seventh loop 900. Connected to seventh loop 900 is ninth ring 907. Connected to ninth ring 907 is a clip 906 which contains a hole 909 through which ring 907 fits through. Attached to clip 906 is an elasticized cord 902. Cord 902 may be made from a rubberized and/or other suitable material that compresses or lengthens as needed. Clip 906 is attached to cord 902 at one end and a corresponding clip 905 is attached to cord 902 on its other end. Clip 905 also contains a hole 910 through which a tenth ring 901 fits. Tenth ring 901 is attached to a transparent pouch 804 which may contain a comb 812 or the like.

As shown in FIG. 1, on the upper part of face 102 of front wall 100 is attached a male snap 104. On the upper part of face 401 of second interior wall 400 is attached a female snap 105. Preferably, male and female snaps 104, 105 should be located adjacent the midpoint between first and second side walls 90, 80 on faces 102, 401 respectively. In this manner, when snaps 104, 105 engage, any contents of the bag between the front and second interior walls 100, 400 will not be able to fall out of the bag, there being a snug fit between the front and second interior walls 100, 400 as a result of the engagement of snaps 104, 105.

As shown in FIG. 1, attached to face 401 adjacent first side wall 90 is a pocket 409 which is capable of housing a 14 15 notepad 410 which is shown in FIG. 2 as fitting within pocket 409 which is there located adjacent second side wall 80 instead of adjacent to first side wall 90 as shown in FIG. 1. Also attached to face 401, as shown in FIG. 1 between pocket 409 and second side wall 80, is pocket 411 which is capable of housing a pen or pencil 412. Additionally, a pocket 413 is attached to face 401 between pocket 411 and second side wall 80. This pocket 413 may be used to store a cosmetic case 414 which is shown in FIG. 2 as fitting within pocket 413 which is there located adjacent first side wall 90 instead of adjacent to second side wall 80 as shown in FIG. 1. As shown in FIG. 1, below pocket 413 are pockets 415 which may be used to store lipstick cases 416, as shown in FIG. 2, or the like. Similarly, pocket 106 adjacent first side wall 90 is attached onto the upper half of face 102 of front wall 100 and may store a cell phone 107 or case 802 which may contain eyeglasses 810 as shown in FIG. 2. A series of pockets 108, one nearly on top of the other, are attached onto face 102 between pocket 106 and second side wall 80. Pockets 108 may be used to store credit cards 811 which are shown in FIG. 2. The uppermost portion of pockets 108 may be used to store a wallet 801 as shown in FIG. 2.

FIG. 2 illustrates an alternative embodiment for the pockets shown in FIG. 1. Pocket 409, as shown in FIG. 2, is located adjacent second side wall 80 instead of being located near first side wall 90 as shown in FIG. 1. Pockets 413 and 415 are shown in FIG. 2 adjacent first side wall 90 instead of being located near second side wall 80 as shown in FIG. 1.

FIG. 3 illustrates another alternative embodiment of FIG. 1. In FIG. 3, wallet 801 is shown as insertable in the uppermost portion of pockets 108. Pocket 106, shown on second face 102 in FIGS. 1 and 2, is now shown on thirteenth face 401 adjacent first side wall 90 in FIG. 3. Pocket 106 may be used to store a cell phone 107 or case 802 which may contain glasses 810. Pockets 413 and 415, located on thirteenth face 401 and used to store a cosmetic case 414 and lipstick cases 416 or the like in FIGS. 1 and 2, are shown attached to second face 102 in FIG. 3 near first side wall 90 in FIG. 3.

Figure 4:
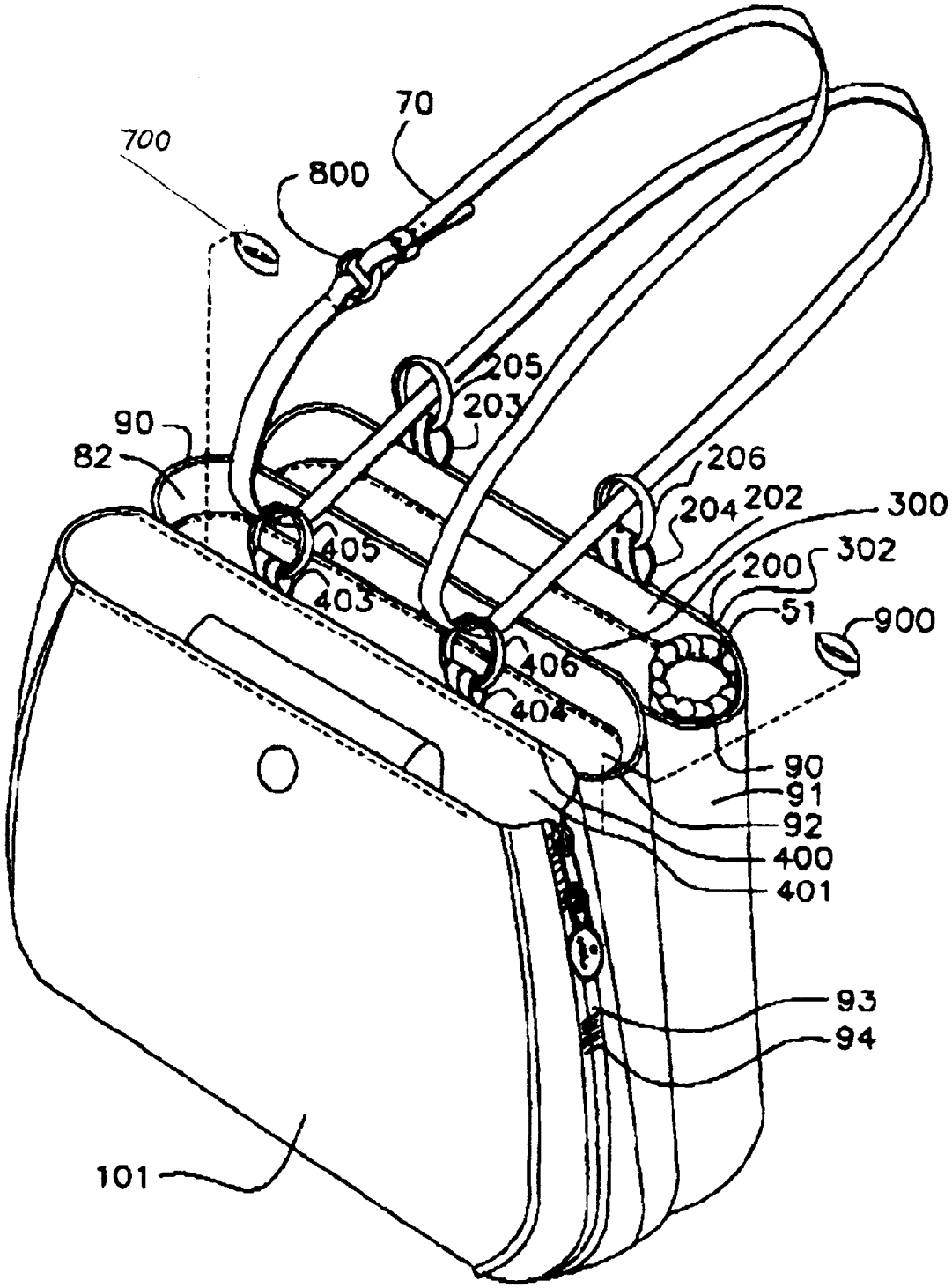

FIG. 4 illustrates another front view of the invention and shows first face 101 of front wall 100. The male and female zipper arrangement 93, 94 is shown in a closed position, such that first side wall 90 extends from the front to back walls 100, 200 of bag 10. The pager and transparent pouch loops 700, 900 are shown without the connecting attachments shown in FIGS. 2 and 3.

Figure 5:
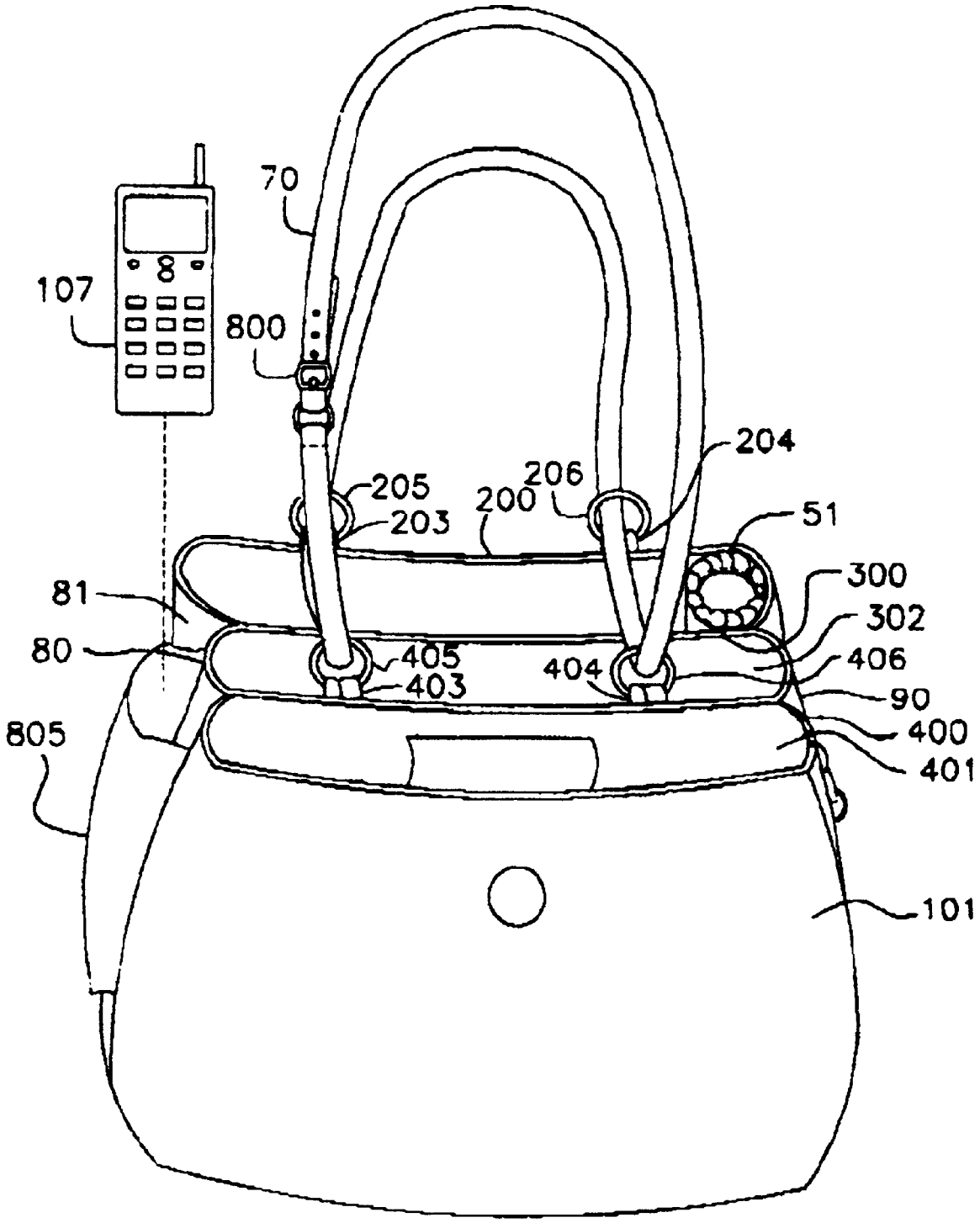

FIG. 5 illustrates an alternative embodiment of FIGS. 1–4. In FIG. 5, the cell phone 107 is shown as being housed on the outside portion of bag 10 in pocket 805, which is attached to the ninth face 81 of second side wall 80. In FIGS. 2 and 3, however, the cell phone 107 is shown as being located within pocket 106 located on the inside portion of bag 10 on either the second face 102 of front wall 100 or thirteenth face 401 of second interior wall 400.

Figure 6:
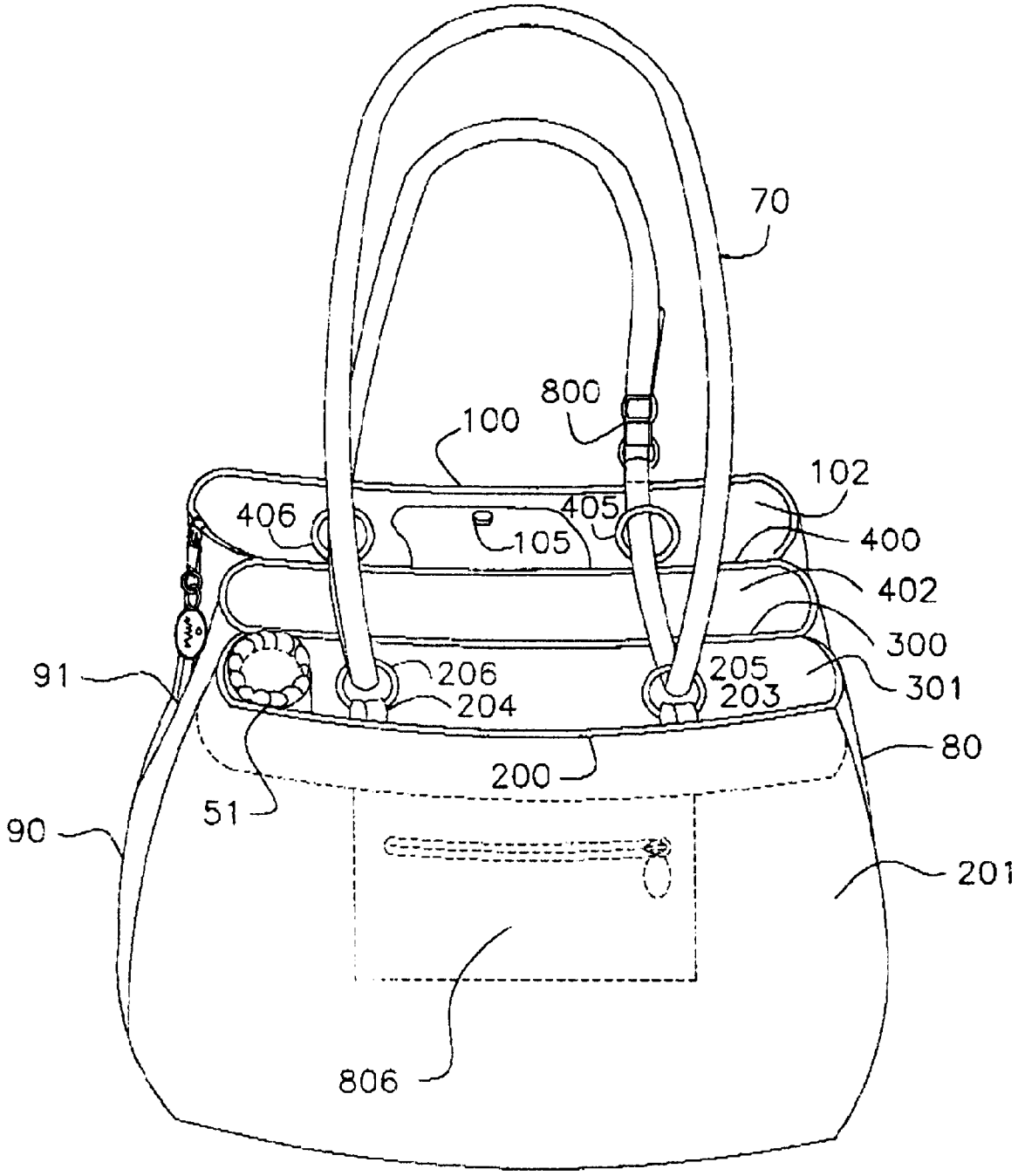
FIG. 6 is a rear or back elevation view of the invention.

FIG. 6 illustrates a rear view of bag 10 and shows the zipped pocket 806 attached to fourth face 202 of back wall 200. Pocket 806 is located on the upper part of fourth face 202 nearly equidistant from first and second walls 90, 80.

Figure 7:
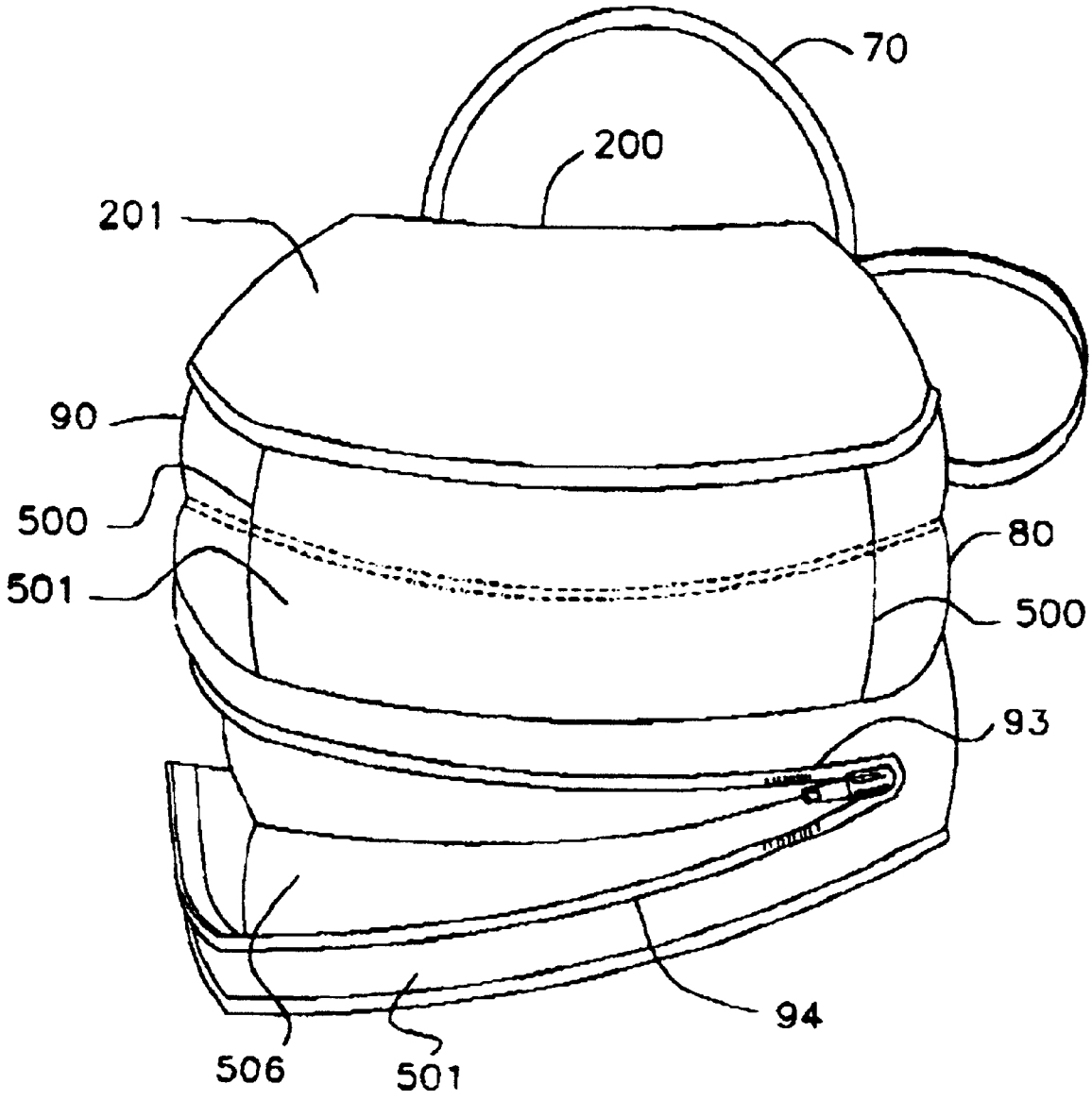
FIG. 7 is a bottom view of the invention.
Figure 8:
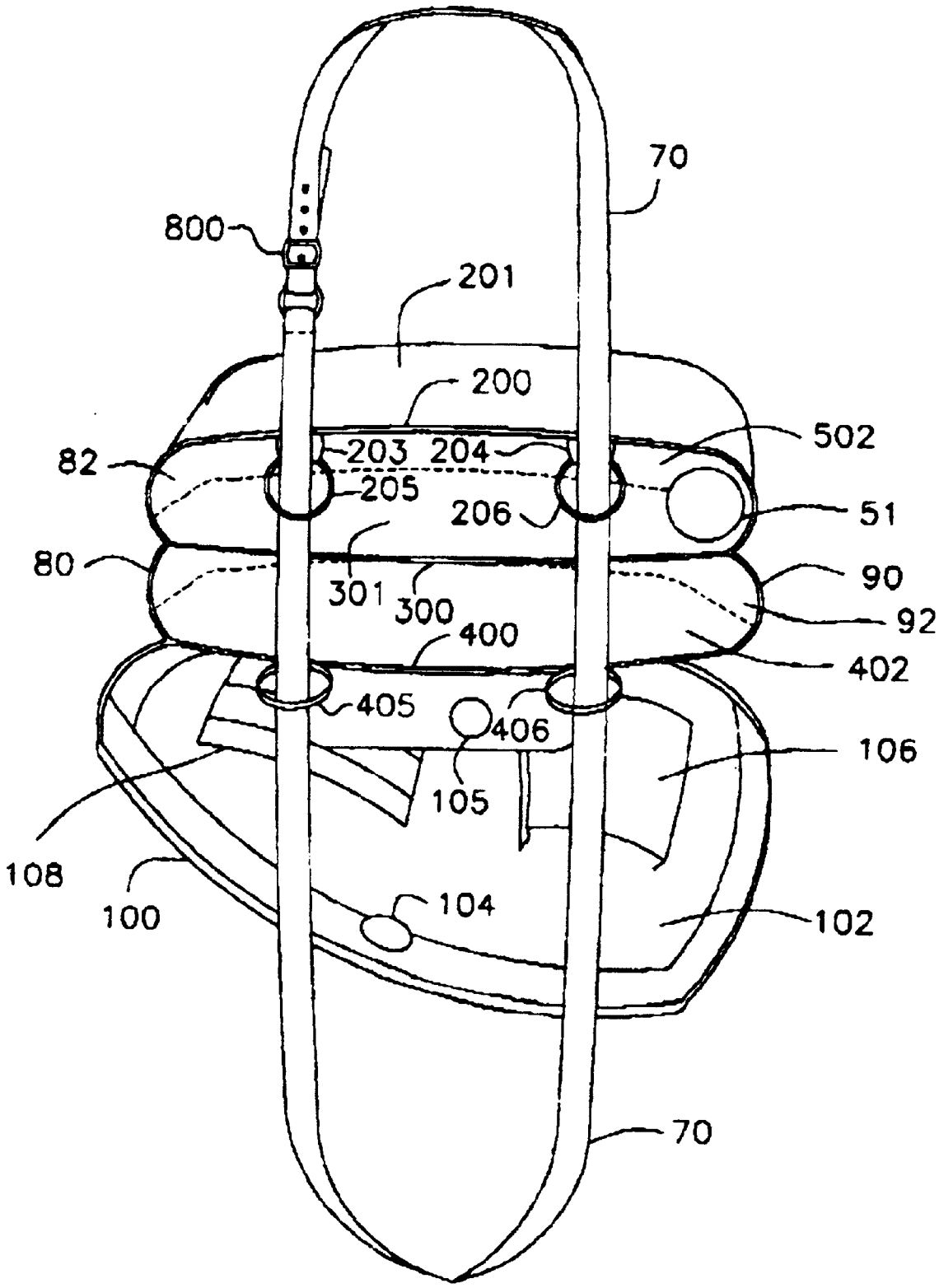
FIG. 8 is a top view of the invention.
Figure 9:
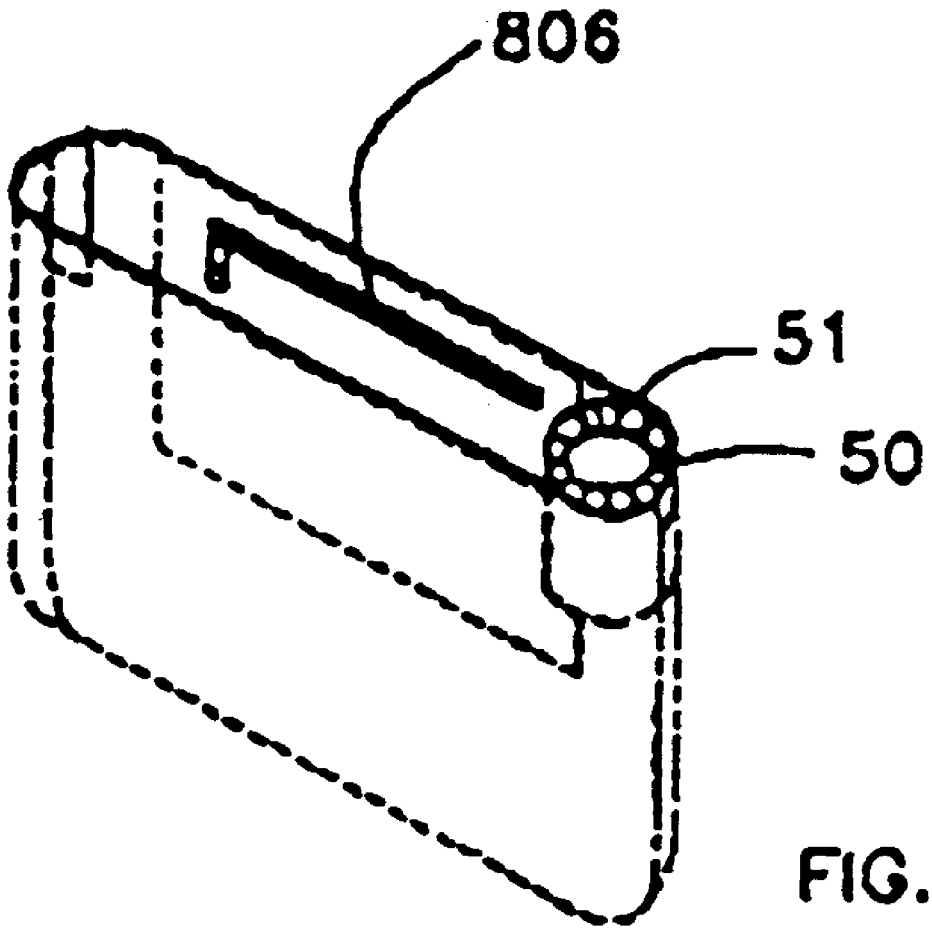

FIG. 7 illustrates the inventive bag 10 from a bottom perspective when the zipper arrangement 93, 94 is unzipped. Eleventh face 501 of bottom wall 500 is shown in FIG. 7. FIG. 8 illustrates the inventive bag from a top view. Twelfth face 502 of bottom wall 500 is shown. Similarly, sixth face 92 of first side wall 90, tenth face 82 of second side wall 80 and seventh face 301 of first interior wall 300 are shown in FIG. 8.

What I claim is:

1. A carrying bag containing at least five walls including a front, back, and bottom wall and two side walls further comprising:

(a) a first and second face located on opposite sides of the front wall of said bag;

(b) a third and fourth face located on opposite sides of the back wall of said bag;

(c) a fifth and sixth face located on opposite sides of one side wall, whereby said side wall is attached to the front and back walls, of said bag;

(d) an interior wall of said bag containing a thirteenth and fourteenth face, whereby said interior wall is located between the front and back walls and is attached to the bottom and two side walls of said bag;

(e) a ninth and tenth face located on opposite sides of the other side wall of said bag, whereby said other side wall is attached to the interior and back walls of said bag;

(f) an eleventh and twelfth face located on opposite sides of the bottom wall of said bag, whereby said bottom wall is attached to the two side walls and the interior and back walls of said bag;

(g) loops attached to the interior and back walls of the bag;

(h) rings fitting through said loops;

(i) an adjustable, flexible strap fitting through each of said rings;

(j) a male zipper section attached to at least two of said interior, other side and bottom walls of said bag;

(k) a female zipper section attached to the bottom and front walls of said bag, such that when the male and female zipper sections are zipped, the other side wall and bottom wall extend from the front wall to the back wall of said bag; and (l) a generally triangular shaped flap located between, and attached to, a portion of the bottom end of the front and interior walls, such that when the male and female zipper sections are unzipped, the other side wall extends from the back wall to the interior wall of the bag and said flap provides the bottom wall of the bag between the front and interior walls thereof.

2. The carrying bag of claim 1 further comprising:

(a) a first interior wall containing a seventh and eighth face, said first interior wall being attached to the bottom and two side walls of the bag and located between said interior and back walls of the bag;

(b) a coin pouch located between the first interior and back walls of said bag and attached to a side wall of said bag, said pouch having an elasticized top end which is normally in a closed position and which may be opened manually while the bag is resting on a person's shoulder; and (c) wherein said loops and rings do not exceed four in number and the third and fourth loops and rings respectively are generally the same distance away from each sidewall as are the first and second loops and rings respectively.

3. The carrying bag of claim 2 further comprising:

(a) a fifth loop located between the back and first interior walls of said bag and attached to at least one of said fourth, sixth, seventh, tenth and twelfth faces of the walls of said bag;

(b) a fifth ring fitting through said fifth loop; and (c) a means to attach a key to said fifth ring.

4. The carrying bag of claim 2 further comprising:

(a) a sixth loop located between said interior and first interior walls of said bag and attached to at least one of said sixth, eighth, tenth, twelfth and fourteenth faces of the walls of said bag;

(b) a seventh ring fitting through said sixth loop;

(c) a means to attach a pager to said seventh ring;

(d) a seventh loop located between said interior and first interior walls of said bag and attached to at least one of said sixth, eighth, tenth, twelfth and fourteenth faces of the walls of said bag;

(e) a ninth ring fitting through said seventh loop; and (f) a means to attach a pouch to said ninth ring.

5. The carrying bag of claim 1 further comprising:

(a) a male snap section attached to the second face of the front wall of said bag;

(b) a female snap section attached to the thirteenth face of the interior wall of said bag, said female snap being aligned with the male snap so that when the snaps are pressed together the bag is closed between the front and interior walls of said bag;

(c) a first pocket attached to the second face of the front wall of said bag, said pocket being wide and deep enough to house a cellular phone; and (d) a plurality of pockets adjacent said first pocket and attached to the second face of the front wall of said bag, said pockets containing an upper pocket capable of housing a wallet and a plurality of lower pockets being wide and deep enough to house a plurality of credit cards.

6. The carrying bag of claim 1 further comprising:

(a) a first interior pocket attached to the fourteenth face of the interior wall of said bag, said first interior pocket being wide and deep enough to house a notepad;

(b) a second interior pocket attached to the fourteenth face of the interior wall of said bag, said second interior pocket being wide and deep enough to house a writing implement;

(c) a third interior pocket attached to the fourteenth face of the interior wall of said bag, said third interior pocket being wide and deep enough to house a cosmetic case; and (d) a fourth interior pocket attached to the fourteenth face of the interior wall of said bag, said fourth interior pocket being wide and deep enough to house a lipstick case.

7. The carrying bag of claim 1 further comprising:

(a) a fifth interior pocket located between the back and interior walls of said bag and attached to the third face of the back wall of said bag, said fifth interior pocket being wide and deep enough to house any handbag item.

8. The carrying bag of claim 1 further comprising:

(a) an exterior pocket located on one of said first, third, fifth and ninth faces of the walls of said bag, said exterior pocket being deep and wide enough to house a portable phone.

* * * * *